US011192271B2

(12) United States Patent
Roden et al.

(10) Patent No.: US 11,192,271 B2
(45) Date of Patent: Dec. 7, 2021

(54) CHAINSAW SYSTEM

(71) Applicant: Robert Bosch GmbH, Stuttgart (DE)

(72) Inventors: Jack Roden, Stowmarket (GB); Attila Nagy, Miskolc-Szirma (HU); Richard Wilkins, Ipswich (GB); Richard Poole, Bury St. Edmunds (GB); Csaba Szmutko, Miskolc (HU); John Lister, Bury St. Edmunds (GB)

(73) Assignee: Robert Bosch GmbH, Stuttgart (DE)

( * ) Notice: Subject to any disclaimer, the term of this patent is extended or adjusted under 35 U.S.C. 154(b) by 63 days.

(21) Appl. No.: 16/635,407

(22) PCT Filed: Sep. 5, 2018

(86) PCT No.: PCT/EP2018/073793
§ 371 (c)(1),
(2) Date: Jan. 30, 2020

(87) PCT Pub. No.: WO2019/057487
PCT Pub. Date: Mar. 28, 2019

(65) Prior Publication Data

US 2021/0094202 A1 Apr. 1, 2021

(30) Foreign Application Priority Data

Sep. 25, 2017 (DE) ..... 10 2017 216 870.6

(51) Int. Cl.
*B27B 17/02* (2006.01)
*B27B 17/14* (2006.01)

(52) U.S. Cl.
CPC ..... *B27B 17/02* (2013.01); *B27B 17/14* (2013.01)

(58) Field of Classification Search
None
See application file for complete search history.

(56) References Cited

U.S. PATENT DOCUMENTS 4,316,327 A * 2/1982 Scott ..... B27B 17/14 30/386
4,382,334 A 5/1983 Reynolds
(Continued)

FOREIGN PATENT DOCUMENTS

DE 25 42 775 A1 3/1977
DE 28 06 108 A1 8/1979
(Continued)

OTHER PUBLICATIONS

International Search Report corresponding to PCT Application No. PCT/EP2018/073793, dated Jan. 4, 2019 (German and English language document) (5 pages).

*Primary Examiner* — Hwei-Siu G Payer
(74) *Attorney, Agent, or Firm* — Maginot, Moore & Beck LLP

(57) ABSTRACT

A chainsaw system includes a chainsaw and a saw blade module, which has a cutting chain and at least one guide unit for forming a guide for at least one part of the cutting chain. The chainsaw system further includes at least one coupling unit for coupling the saw blade module to the chainsaw and at least one release unit that has at least one fastening element and is provided in order to provide tool-free decoupling of the at least one saw blade module which is coupled by means of the coupling unit.

12 Claims, 7 Drawing Sheets

(56) References Cited

U.S. PATENT DOCUMENTS

| | | | | | |
|---|---|---|---|---|---|
| 4,819,335 | A * | 4/1989 | Alexander | B27B 17/02 | 30/122 |
| 5,249,362 | A * | 10/1993 | Harding | F16B 2/065 | 30/381 |
| 9,789,625 | B2 * | 10/2017 | Engelfried | B27B 17/14 | |
| 2015/0158199 | A1 * | 6/2015 | Engelfried | B27B 17/14 | 30/383 |
| 2015/0321376 | A1 * | 11/2015 | Engelfried | B27B 17/02 | 30/383 |
| 2021/0094202 | A1 * | 4/2021 | Roden | B27B 17/14 | |

FOREIGN PATENT DOCUMENTS

| | | | |
|---|---|---|---|
| DE | 699 06 891 | T2 | 12/2003 |
| DE | 10 2012 211 087 | A1 | 1/2014 |
| DE | 10 2012 211 094 | A1 | 1/2014 |
| DE | 10 2012 211 102 | A1 | 1/2014 |
| JP | 9-29667 | A | 2/1997 |

* cited by examiner

CHAINSAW SYSTEM

This application is a 35 U.S.C. § 371 National Stage Application of PCT/EP2018/073793, filed on Sep. 5, 2018, which claims the benefit of priority to Serial No. DE 10 2017 216 870.6, filed on Sep. 25, 2017 in Germany, the disclosures of which are incorporated herein by reference in their entirety.

BACKGROUND

There has already been proposed a chainsaw system, comprising a chainsaw and a saw blade module that comprises a cutting strand and at least one guide unit for guiding at least a part of the cutting strand, and comprising at least one coupling unit for coupling the saw blade module to the chainsaw.

SUMMARY

The disclosure is based on a chainsaw system, comprising a chainsaw and a saw blade module that comprises a cutting strand and at least one guide unit for guiding at least a part of the cutting strand, and comprising at least one coupling unit for coupling the saw blade module to the chainsaw.

It is proposed that the chainsaw have at least one release unit, which comprises at least one actuating element and which is designed for decoupling, without use of tools, the at least one saw blade module coupled by means of the coupling unit.

A "coupling unit" is to be understood here to mean, in particular, a unit designed to operatively connect the saw blade module to the portable chainsaw, by means of a form-fit and/or force-fit connection, for the purpose of performing work on a workpiece. In particular, when the coupling unit is connected to the chainsaw and the portable chainsaw is in an operating state, forces and/or torques can be transmitted from a transmission unit of the portable chainsaw to the saw blade module, in particular by means of a torque transmission element of the portable chainsaw, for the purpose of driving the cutting strand. Preferably, the portable chainsaw has a torque transmission element that, when the saw blade module is coupled to the portable chainsaw by means of the coupling unit, engages in the cutting strand for the purpose of driving the cutting strand. The torque transmission element is preferably arranged on the portable chainsaw, in particular arranged in a rotatably mounted manner. The torque transmission element may be realized, in particular, as a toothed shaft of a transmission unit of the portable chainsaw. The torque transmission element may also be realized as another component considered appropriate by persons skilled in the art. A "release element" in this context is to be understood to mean, in particular, a unit designed to release a form-fit and/or force-fit connection, between the saw blade module and the chainsaw, that is produced by means of the coupling unit and that couples the saw blade module to the chainsaw. In particular, the release unit is designed to release the form-fit and/or force-fit connection, between the saw blade module and the chainsaw, that is produced by means of the coupling unit and that couples the saw blade module to the chainsaw, for the purpose of separating the saw blade module from the chainsaw. An "actuating element" is to be understood to mean, in particular, an element designed to pick up an input quantity from an operator in the case of an operating control action, and in particular to be contacted directly by an operator, wherein contacting of the actuating element is sensed and/or an actuating force exerted upon the actuating element is sensed and/or is transferred mechanically for the purpose of actuating a unit, in particular a release mechanism. In particular, the actuating element is realized as an actuating lever and/or an actuating button.

The saw blade module is realized, in particular, as a closed system. The term "closed system" is intended here to define, in particular, a system comprising at least two components that, by means of combined action, when the system is removed from a system such as, for example, the portable chainsaw, that is of a higher order than the system, maintain a functionality and/or are captively connected to each other when in the removed state. Preferably, the at least two components of the closed system are connected to each other so as to be at least substantially inseparable by an operator. "At least substantially inseparable" is to be understood here to mean, in particular, a connection of at least two components that can be separated from each other only with the aid of parting tools such as, for example, a saw, in particular a mechanical saw, etc. and/or chemical parting means such as, for example, solvents, etc.

A "cutting strand" is to be understood here to mean, in particular, a unit designed to locally undo an atomic coherence of a workpiece on which work is to be performed, in particular by means of a mechanical parting-off and/or by means of a mechanical removal of material particles of the workpiece. Preferably, the cutting strand is designed to separate the workpiece into at least two parts that are physically separate from each other, and/or to part off and/or remove, at least partially, material particles of the workpiece, starting from a surface of the workpiece. Particularly preferably, in at least one operating state, the cutting strand is moved in a revolving manner, in particular along a circumferential direction of the guide unit of the saw blade module. Particularly preferably, the cutting strand is realized as a cutting chain. It is also conceivable, however, for the cutting strand to be of another design, considered appropriate by persons skilled in the art, such as, for example, designed as a cutting belt, on which a plurality of cutting-strand segments of the cutting strand are arranged.

A "guide unit" is to be understood here to mean, in particular, a unit designed to exert a constraining force upon the cutting strand, at least along a direction perpendicular to the cutting direction of the cutting strand, in order to define a movement capability of the cutting strand along the cutting direction. Preferably, the guide unit has at least one guide element, in particular a guide slot, by which the cutting strand is guided, at least partially. Preferably, the cutting strand, as viewed in the cutting plane of the cutting strand, is guided by the guide unit along an entire circumference of the guide unit by means of the guide element, in particular the guide slot. A "cutting direction" is to be understood here to mean, in particular, a direction along which the cutting strand is moved, in at least one operating state, as a result of a driving force and/or a driving torque, in particular in the guide unit, for the purpose of generating a cutting gap and/or for the purpose of parting-off and/or removing material particles of a workpiece on which work is to be performed. "Designed" is to be understood to mean, in particular, specially programmed, configured and/or equipped. That an object is designed for a particular function, is to be understood to mean, in particular, that the object fulfils and/or executes this particular function in at least one application state and/or operating state.

The cutting strand can preferably be tensioned and/or pretensioned by means of the pretensioning unit, in particular when the cutting strand is arranged on the guide unit. The pretensioning unit is preferably designed to effect compensation of a play due to the production process and/or a tolerance due to the production process, in particular when the saw blade module is coupled to the chainsaw. The pretensioning unit is preferably designed to automatically effect compensation of a play due to the production process and/or a tolerance due to the production process, in particular when the saw blade module is coupled to the chainsaw. The pretensioning unit is particularly preferably designed to compensate an elongation of the cutting strand, in particular an elongation of the cutting strand caused by performing work on a workpiece. Particularly preferably, the pretensioning unit is designed preferably to automatically compensate the elongation of the cutting strand, in particular an elongation of the cutting strand caused by performing work on a workpiece. The elongation of the cutting strand, in particular an elongation of the cutting strand caused by performing work on a workpiece, can preferably be compensated automatically by means of the pretensioning unit. "An automatic compensation of play and/or tolerance" in this context is to be understood to mean, in particular, a self-acting compensation of elongation, in particular that can be effected without intervention by an operator, and/or a self-acting compensation of a play and or tolerance of the cutting strand, when arranged on the guide unit, that is/are due to a production process, in particular that can be effected without intervention by an operator, by means of action of at least one tensioning force upon the cutting strand, in particular by an element realized separately from the cutting strand. Particularly preferably, the automatic tensioning and/or the automatic pretensioning of the cutting strand can be achieved without intervention by an operator of the portable chainsaw. Preferably, the pretensioning unit comprises at least one pretensioning element, in particular a spring element, arranged on a housing of the saw blade module. In particular, the pretensioning element is realized as a compression spring. The pretensioning element is preferably designed to exert a pretensioning force, in particular a pretensioning force directed away from the housing, upon the guide unit, on which the cutting strand is arranged. Preferably, the guide unit is mounted in a movable, in particular translationally movable, manner on the housing.

A design according to the disclosure makes it possible to provide a chainsaw system of the generic type that has advantageous features in respect of coupling a saw blade module to a portable chainsaw, and decoupling the saw blade module from the portable chainsaw. In particular, it can be made possible to release the saw blade module from the chainsaw in an advantageously simple manner, in particular without use of tools. This makes it possible, in particular, to achieve advantageously simple and/or rapid changing of the saw blade module.

It is additionally proposed that the chainsaw have at least one blocking unit that is designed at least to prevent the saw blade module, coupled by means of the coupling unit, from being decoupled by means of the release unit while the chainsaw is in operation. In particular, the blocking unit is designed to prevent functioning of the release unit during operation of the chainsaw, in particular while a motor of the chainsaw is running, at least in such a manner that undoing of the form-fit and/or force-fit connection, between the saw blade module and the chainsaw, that is produced by means of the coupling unit and that couples the saw blade module to the chainsaw, is largely prevented. In particular, the blocking unit is designed to block a release mechanism of the release mechanism, at least partially, in particular mechanically, and/or to operatively decouple it, at least partially, from the coupling unit. It is thereby possible, advantageously, to prevent release of the saw blade module while the chainsaw is in operation.

In a preferred design of the disclosure, it is proposed that the blocking unit have at least one decoupling blocking element that is designed to block an actuation of the actuating element of the release unit while the chainsaw is in operation. When the chainsaw is in an idle state, the decoupling blocking element is arranged, in particular, entirely outside of an actuating course of the actuating element of the release unit. In particular, during operation of the chainsaw, in particular while a motor of the chainsaw is running, the decoupling blocking element is arranged, at least partially, in a movement path of the actuating element. In particular, the decoupling blocking element is movably mounted and, upon the chainsaw being put into operation, can be moved, in particular can be slid and/or swiveled, at least partially, into an actuating course of the actuating element of the release unit. It is thereby possible, in an advantageously simple and reliable manner, to prevent actuation of the actuating element while the chainsaw is in operation.

Preferably, the blocking unit has at least one transmission element, which operatively couples an operating switch of the chainsaw to the decoupling blocking element and which is designed to transmit a movement of the operating switch to the decoupling blocking element. The transmission element is realized, in particular, as a transmission arm. In particular, at least one end of the transmission element is connected to an operating switch of the chainsaw. In particular, the end of the transmission element that is connected to the operating switch is designed to follow a movement of the operating switch, at least substantially. Preferably, the transmission element is designed to follow a movement of the operating switch at least substantially over its entire longitudinal extent. The decoupling blocking element is in particular arranged on and connected to a part of the transmission element that extends away from the operating switch. In particular, the transmission element is designed to transmit a movement of the operating switch to the decoupling blocking element in such a manner that the decoupling blocking element is in an actuating course of the actuating element of the release unit, at least partially, when the operating switch of the chainsaw is in an operating position. In addition, the transmission element is designed, in particular, to transmit a movement of the operating switch to the decoupling blocking element in such a manner that the decoupling blocking element is entirely outside of an actuating course of the actuating element of the release unit when the operating switch of the chainsaw is in a neutral position. This makes it possible to effect advantageously simple and/or reliable blocking of the actuating element of the release unit.

It is additionally proposed that the chainsaw have at least one blocking unit that is designed at least to prevent the chainsaw from being put into operation while the release unit is in a decoupling mode. The blocking unit is designed, in particular, to prevent the chainsaw from being put into operation as long as the actuating element of the release unit is in a decoupling position. In particular, the blocking unit may be at least partially integral with the actuating element, for the purpose of blocking the release unit while the chainsaw is in operation. Preferably, the chainsaw has at least one blocking unit that is both designed to block the release unit while the chainsaw is in operation and designed to prevent the chainsaw from being put into operation while the release unit is in a decoupling mode. In particular, the blocking unit is designed to prevent a motor of the chainsaw from being put into operation while the release unit is in a decoupling mode. In particular, the blocking unit may be designed to prevent the chainsaw from being put into operation, in particular being electronically and/or mechanically put into operation. Alternatively or additionally, the blocking unit may be designed to decouple a torque transmission element of the chainsaw from the motor of the chainsaw while the release unit is in a decoupling mode, such that there can be no transmission of torque to the cutting strand of the saw blade module. It is thereby possible to achieve a high degree of operating safety of the chainsaw system, in particular when a saw blade module is being decoupled from the chainsaw. In particular, it is possible, in an advantageously reliable manner, to prevent the chainsaw from being put into operation when a saw blade module is being decoupled.

It is also proposed that the blocking unit have at least one operation blocking element that is designed to block, in particular mechanically, an actuation of an operating switch of the chainsaw while the release unit is in a decoupling mode. The operation blocking element is designed, in particular, to mechanically block, directly or indirectly, at least to a large extent, an actuation course of the operating switch while the release unit is in a decoupling mode. In particular, the operation blocking element is designed to directly or indirectly block the operating switch of the chainsaw, when in a neutral position, while the release unit is in a decoupling mode. In particular, the operation blocking element is connected to the actuating element of the release unit, or is at least partially integral with the actuating element of the release unit. "Integral" is to be understood to mean, in particular, connected in a materially bonded manner such as, for example, by a welding process and/or an adhesive process, etc., and particularly advantageously by being molded-on, for example being produced from a casting and/or by produced in a single or multi-component injection process. In particular, the operation blocking element is designed to follow a movement of the actuating element of the release unit, at least substantially. In particular, the operation blocking element is designed to act upon the decoupling blocking element and block a movement of the decoupling blocking element when the actuating element of the release unit is in a decoupling position. The decoupling blocking element is in particular arranged on and connected to a part of the transmission element that extends away from the operating switch, with the result that a movement of the transmission element is likewise blocked by the blocking of the decoupling blocking element. The transmission element is connected to the operating switch of the chainsaw, with the result that the movement of the operating switch is also blocked. This makes it possible to effect advantageously simple and/or reliable blocking of the operating switch of the chainsaw. It is thereby possible, in an advantageously simple and reliable manner, to prevent the chainsaw from being put into operation while the release unit is in a decoupling mode.

Furthermore, it is proposed that the chainsaw have at least on recoil safeguard element that is designed to prevent, at least to a large extent, a manual actuation of the actuating element of the release unit while the chainsaw is in operation. The recoil safeguard element is realized, in particular, as a recoil lever. In particular, the recoil safeguard element is designed, in the case of a recoil of the chainsaw system resulting from an actuation by an operator of the chainsaw system, to be brought from an operating position into a brake position. In particular, the recoil safeguard element is designed, in the brake position, to cause the chainsaw, in particular the motor of the chainsaw, to brake. In particular, the recoil safeguard element is designed, in an operating position, to mechanically cover the release unit, at least partially, and preferably at least to a large extent. In particular, the recoil safeguard element is designed, in an operating position, to mechanically cover the actuating element by at least 70%, preferably by at least 80%, more preferably by at least 90% and, particular preferably, completely. Manual actuation of the actuating element of the release unit while the chainsaw is in operation can thus advantageously be prevented, at least to a large extent.

In a preferred design of the disclosure, it is proposed that the coupling unit have at least one locking unit, and at least one locking element that is designed to latch within the locking unit. In particular, the locking element may be arranged on the saw blade module, and the locking unit on the chainsaw. Alternatively, the locking element may be arranged on the chainsaw, and the locking unit on the saw blade module. The locking unit may be realized, in particular, in the form of a pin or bolt. The locking unit has, in particular, a receiving recess that is designed to receive the locking element, at least partially. In particular, the locking element has at least one latching means that is designed to latch, preferably automatically, within the receiving recess when inserted in the receiver of the locking unit. The latching means may be realized, in particular, as a material recess, a material projection, an in particular spring-preloaded expansion head and/or an in particular spring-preloaded tensioning head. In particular, the latching means is designed, upon insertion, to latch, preferably automatically, with a corresponding locking element of the locking unit, and/or within the receiving recess, in particular as a result of expanding, at least partially. In particular, the release unit is designed to release the latching connection produced by means of the locking element. In particular, the latching connection produced by means of the locking element can be undone by an actuation of the actuating element of the release unit. An advantageously simple and/or secure mechanical coupling, between the saw blade module and the chainsaw, can thereby be achieved.

It is additionally proposed that the locking element have at least one locking head, and the locking unit have at least one locking element that is designed to engage behind the locking head, at least in a locking state. In particular, the locking element is realized as a bolt, having an in particular circumferential groove. The locking head is formed, in particular, by the circumferential groove on the bolt. The locking element of the locking unit is designed, upon insertion of the locking element into the locking unit, to engage in the groove. In particular, the locking element may be spring-preloaded, such that it latches automatically into the groove and is held in the locking position by a spring force. The locking unit is preferably designed, at least when the saw blade module is arranged on the chainsaw, to support and/or transmit transverse forces, in particular along a transverse forces that is at least substantially parallel to a drive axis of a torque transmission element of the chainsaw. Advantageously secure fastening of the saw blade module to the chainsaw can thus be effected.

Preferably, the locking unit may have at least one magnet element that is designed, in at least one operating state, to exert a holding force upon the locking element. In particular, the magnet element is designed, at least upon an actuation of the actuating element of the release unit, to exert a magnetic holding force upon the locking element. This makes it possible to achieve advantageously safe release of the saw blade module from the chainsaw.

It is additionally proposed that the chainsaw have at least one receiving recess that is designed to receive the saw blade module, at least partially, in a mounted state. In particular, the receiving recess is formed, at least partially, from a housing of the chainsaw. The receiving recess has at least one inner contour that corresponds, at least substantially, to an outer contour of a housing of the saw blade module. In particular, the receiving recess of the chainsaw is designed to receive at least the housing of the saw blade module.

Preferably, the coupling unit has at least one positioning bolt that is designed to align and/or orient the saw blade module relative to the chainsaw. Alternatively or additionally, the receiving recess of the chainsaw is designed to align and/or orient the saw blade module relative to the chainsaw. The positioning bolt is at least substantially parallel to the locking element. "Substantially parallel" is to be understood here to mean, in particular, an alignment of a direction relative to a reference direction, in particular in one plane, the direction deviating from the reference direction by, in particular, less than 8°, advantageously less than 5°, and particularly advantageously less than 2°. Advantageously simple positioning of the saw blade on the chainsaw can thus be achieved. The positioning bolt is preferably designed, in at least one state in which the saw blade module is arranged on the chainsaw, to support forces and/or moments acting upon the chainsaw via the saw blade module, in particular forces and/or moments in a plane extending at least substantially perpendicularly in relation to a drive axis of the torque transmission element of the chainsaw. Preferably, the positioning bolt is realized as a counter-bearing for supporting drive moment and/or supporting drive force. Preferably, the saw blade module can be arranged with little play, at least substantially, on the chainsaw by means of the positioning bolt.

Additionally proposed is a saw blade module for use in a chainsaw system according to the disclosure, having at least one coupling unit for coupling the saw blade module to a chainsaw, a cutting strand, and at least one guide unit for guiding at least a part of the cutting strand.

Also proposed is a chainsaw for use in a chainsaw system according to the disclosure. In particular, the chainsaw has at least one motor, in particular an electric or internal combustion motor, which is designed to drive a cutting strand of a saw blade module coupled to the chainsaw.

The chainsaw system according to the disclosure, the saw blade module according to the disclosure and/or the power tool system according to the disclosure are/is not intended in this case to be limited to the application and embodiment described above. In particular, the chainsaw system according to the disclosure, the saw blade module according to the disclosure and/or the power tool system according to the disclosure may have individual elements, components and units that differ in number from a number stated herein, in order to fulfill a functionality described herein. Moreover, in the case of the value ranges specified in this disclosure, values lying within the stated limits are also to be deemed as disclosed and applicable in any manner.

BRIEF DESCRIPTION OF THE DRAWINGS

Further advantages are given by the following description of the drawing. The drawing shows two exemplary embodiments of the disclosure. The drawing, the description and the claims contain numerous features in combination. Persons skilled in the art will also expediently consider the features individually and combine them to create appropriate further combinations.

There are shown.

DETAILED DESCRIPTION

Figure 1:
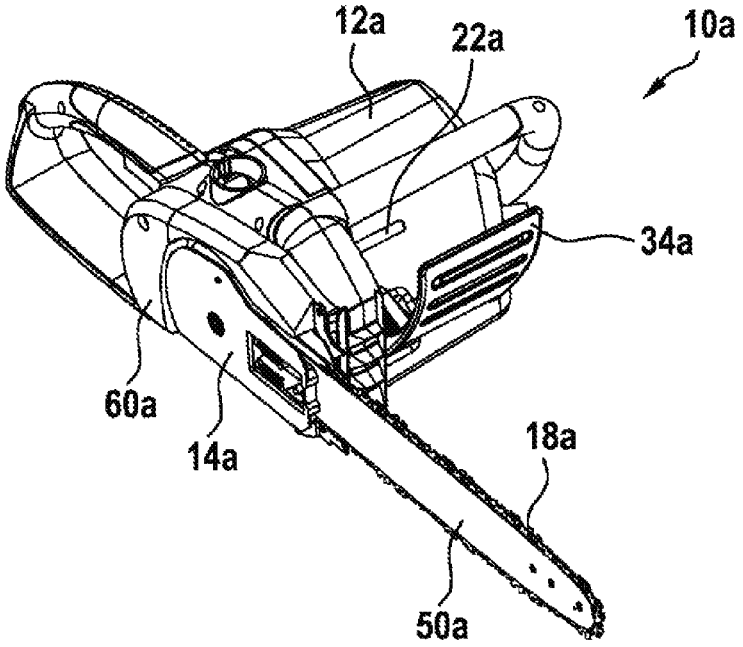
FIG. 1 a chainsaw system, having a chainsaw and a saw blade module in a coupled state, in a schematic representation, FIG. 2 a chainsaw system, in an uncoupled state, in a schematic representation, FIG. 3*a* an exploded representation of a locking unit and a release unit of the chainsaw system, in a schematic representation, FIG. 3*b* an explode representation of the saw blade module, in a schematic representation, FIG. 4 a blocking unit of the chainsaw system, in an initial state, in a schematic representation, FIG. 5 the blocking unit or the chainsaw system during operation of the chainsaw, in a schematic representation, FIG. 6 a blocking unit of the chainsaw system in a decoupling state for releasing the saw blade module, in a schematic representation, FIG. 7 a recoil safeguard element of the chainsaw, which partially covers an actuating element of the release unit, in a schematic representation, FIG. 8 an alternative recoil safeguard element of the chainsaw, which partially covers an actuating element of the release unit, in a schematic representation, FIG. 9 a further alternative recoil safeguard element of the chainsaw, which partially covers an actuating element of the release unit, in a schematic representation, and FIG. 10 an alternative chainsaw system, having a chainsaw and a saw blade module in a uncoupled state, in a schematic representation.
Figure 2:
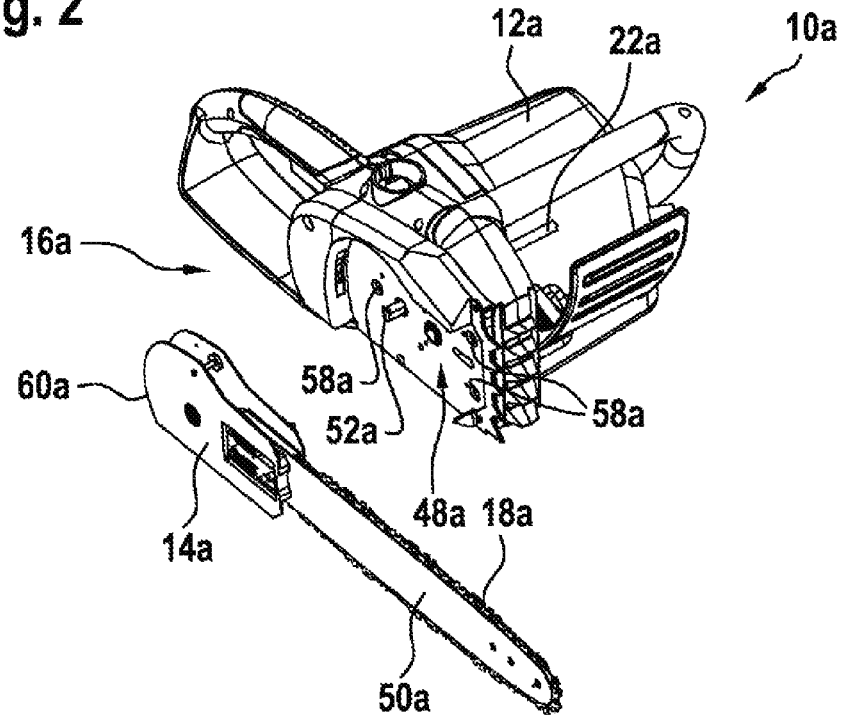

FIG. 1 shows a perspective representation of a chainsaw system 10*a*, having a chainsaw 12*a* and a saw blade module 14*a*, in a mounted state. FIG. 2 shows a perspective representation of a chainsaw system 10*a* in an unmounted state, in which the saw blade module 14*a* is decoupled from the chainsaw 12*a*. The saw blade module 14*a* has a cutting strand 18*a*, and at least one guide unit 50*a* for guiding at least a part of the cutting strand 18*a*. The chainsaw system 10*a* also has a coupling unit 16*a* for coupling the saw blade module 14*a* to the chainsaw 12*a*. The coupling unit 16*a* is designed to connect the saw blade module 14*a* to the portable chainsaw 12*a*, by means of a form-fit and/or force-fit connection, for the purpose of performing work on a workpiece. In particular, when the coupling unit 16*a* is connected to the chainsaw 12*a* and the chainsaw 12*a* is in an operating state, forces and/or torques are transmitted from a transmission unit of the chainsaw 12*a* to the saw blade module 14*a*, for the purpose of driving the cutting strand 18*a*. Preferably, the chainsaw 12*a* has a torque transmission element 52*a* which, when the saw blade module 14*a* is coupled to the chainsaw 12*a* by means of the coupling unit 16*a*, engages in the cutting strand 18*a*, or in a pinion 98*a* of the saw blade module 14*a* that is rotatably mounted in a housing 60*a* of the saw blade module 14*a* (see FIG. 3*b*) for the purpose of driving the cutting strand 18*a*. The torque transmission element 52*a* is arranged in a rotatably mounted manner on the chainsaw 12*a*. The torque transmission element 52*a* may be realized, in particular, as a toothed shaft 54*a* of a transmission unit of the portable chainsaw 12*a*. The chainsaw 12*a* has at least one receiving recess 48*a* that is designed to receive the saw blade module 14*a*, at least partially, in a mounted state. The receiving recess 48*a* has at least one inner contour that corresponds, at least substantially, to an outer contour of the housing 60*a* of the saw blade module 14*a*.

Figure 3A:
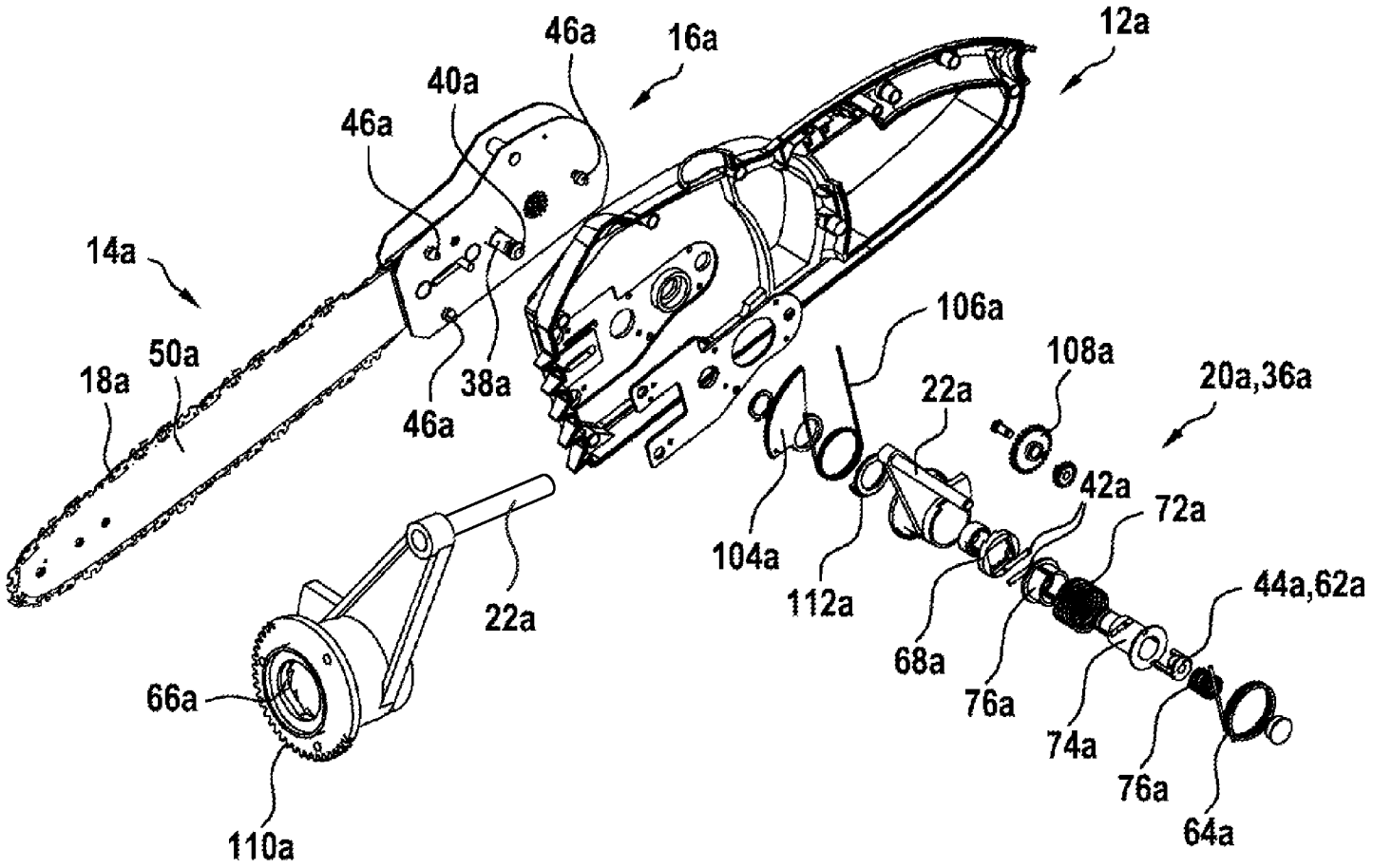

The coupling unit 16*a* has a locking unit 36*a*, and at least one locking element 38*a* that is designed to latch within the locking unit 36*a*. The chainsaw 12*a* also has at least one release unit 20*a*, having at least one actuating element 22*a* that is designed to decouple the at least one saw blade module 14*a*, coupled by means of the coupling unit 16*a*, without use of tools. The locking unit 36*a* and the release unit 20*a* are realized, at least partially, as a single piece. FIG. 3*a* shows the locking unit 36*a* and the release unit 20*a* in an exploded representation. The locking element 38*a* has at least one locking head 40*a*, and the locking unit 36*a* has at least one locking means 42*a* that is designed to engage behind the locking head 40*a*, at least in a locking state. Here, for example, the coupling unit 16*a* has two locking elements 38*a*, realized as locking pins. Upon the locking element 38*a* being inserted into the locking unit 36*a*, a fork element 62*a* is pushed out of the locking position by the locking element 38*a*. The actuating element 22*a* of the release unit 20*a* is rotated into a locking position by a torsion spring 64*a*. In an interior, the actuating element 22*a* has a cam track 66*a* that is rotated jointly with the actuating element 22*a*. A lever element 68*a* and a release ring 70*a* are displaced by a compression spring 72, as a result of which the locking means 42*a* are released and go into a locking position. The coupling unit 16*a* also has at least one positioning bolt 46*a* that is designed to align and/or orient the saw blade module 14*a* relative to the chainsaw 12*a*. For example, the coupling unit 16*a* has three positioning bolts 46*a*, while the chainsaw 12*a* has a corresponding number of receivers 58*a* for the positioning bolts 46*a*. Upon the saw blade module 14*a* being mounted on the chainsaw 12*a*, the positioning bolts 46*a* engage in the receivers 58*a* for the purpose of positioning the saw blade module 14*a* relative to the chainsaw 12*a*.

The release unit 20*a* is designed to undo the form-fit and/or force-fit connection, between the saw blade module 14*a* and the chainsaw 12*a*, that is produced by means of the coupling unit 16*a* and that couples the saw blade module 14*a* to the chainsaw 12*a*. In particular, the release unit 20*a* is designed to undo the form-fit and/or force-fit connection, between the saw blade module 14*a* and the chainsaw 12*a*, that is produced by means of the coupling unit 16*a* and that couples the saw blade module 14*a* to the chainsaw 12*a*, for the purpose of separating the saw blade module 14*a* from the chainsaw 12*a*. For the purpose of decoupling, the actuating element 22*a* of the release unit 20*a* is actuated in a rotary movement. The cam track 66*a* creates a pull on the lever element 68*a*. The locking means 42*a* are moved out of the locking position by a cam mechanism element 74*a* that is pressed in the direction of the actuating element 22*a* by means of a spring element 76*a*. The locking unit 36*a* has at least one magnet element 44*a* that is designed, in at least one operating state, to exert a holding force upon due locking element 38*a*. Preferably, the magnet element 44*a* is designed, upon an actuation of the actuating element 22*a* of the release unit 20*a*, to exert a magnetic holding force upon the locking element 38*a*. When the saw blade module 14*a* is being decoupled from the chainsaw 12*a*, this magnetic holding force must be overcome by an operator of the chainsaw system 10*a*. It is thereby possible to prevent, in particular, the locking element 38*a* from inadvertently slipping out, and thus to prevent inadvertent release of the saw blade module 14*a* from the chainsaw 12*a* upon actuation of the actuating element 22*a* of the release unit 20*a*.

Figure 3B:
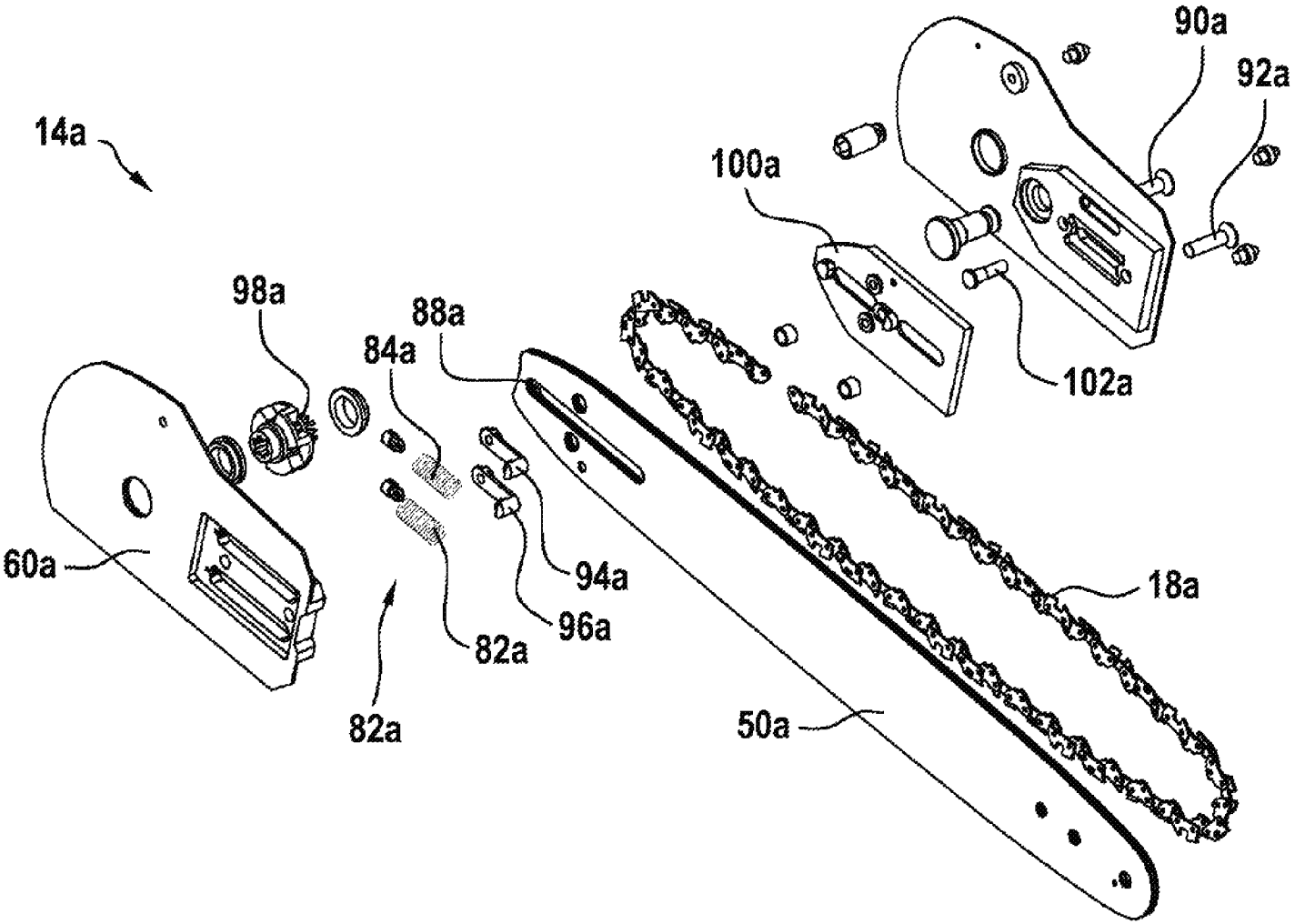

The saw blade module 14*a* preferably comprises at least one pretensioning unit 82*a* for automatically compensating a play due to the production process and/or a tolerance of the cutting strand 18*a* due to the production process (see FIG. 3*b*). Preferably, the pretensioning unit 82*a* comprises at least one pretensioning element 84*a*, 86*a*, in particular a spring element, arranged on the housing 60*a* of the saw blade module 14*a*. In the design represented in FIG. 3*b*, the pretensioning unit 82*a* has at least two pretensioning elements 84*a*, 86*a*, which are realized as spring elements, in particular as compression springs. It is also conceivable, however, for the pretensioning unit 82*a* to comprise a number of pretensioning elements 84*a*, 86*a*' other than two. The pretensioning element/s 84*a*, 86*a* is/are preferably designed to exert a pretensioning force, in particular a pretensioning force directed away from the housing, upon the guide unit 50*a*, on which the cutting strand 18*a* is arranged. Preferably, the guide unit. 50*a* is mounted in a movable, in particular translationally movable, manner on the housing 60*a*. The guide unit 50*a* preferably has at least one movement guide element 88*a*, in particular a guide slot. The movement guide element 88*a* preferably acts in combination with at least one, in particular at least two, counter-guide element/s 90*a*, 92*a* of the saw blade module 14*a*. The counter-guide element/s 90*a*, 92*a* is/are preferably realized as a guide bolt or as a guide sleeve/s. The counter-guide element/s 90*a*, 92*a* preferably engage, at least partially, in the movement guide element 88*a*, in particular in the movement guide element 88*a* realized as a guide slot, or extend through the movement guide element 88*a*. A maximum movement distance of the guide unit 50*a* relative to the housing 60*a* can preferably be limited by means a combined action of the movement guide element 88*a* and the counter-guide element/s 90*a*, 92*a*. One end of the pretensioning element/s 84*a*, 86*a* is preferably supported on the housing 60*a*, in particular on a wall of the housing 60*a* that delimits a recess of the housing 60*a*. Another end of the counter-guide element/s 90*a*, 92*a* is/are supported on the guide unit 50*a* and/or on at least one support element 94*a*, 96*a* arranged on the guide unit 50*a* or on a slide element 100*a* of the saw blade module 14*a*. The slide element 100*a* is preferably fixed to the guide unit 50*a*. The slide element 100*a* is preferably mounted in the housing 60*a* so as to be movable, in particular translationally movable, together with the guide unit 50*a*, relative to the housing 60*a*. A tensioning bolt 102*a* of the pretensioning unit 82*a* is fixed to the guide unit 50*a* and/or to the slide element 100*a*. The tensioning bolt 102*a* extends out of the housing 60*a*, in particular along a direction that is at least substantially perpendicular to a cutting plane of the cutting strand 18*a*.

When the saw blade module 14*a* is arranged on the chainsaw 12*a*, the tensioning bolt 102*a* extends into the chainsaw 12*a*. When the saw blade module 14*a* is arranged on the chainsaw 12*a*, the tensioning bolt 102*a* can operatively connected to an eccentric element 104*a* of the release unit 20*a* and/or the locking unit 36*a*. In at least one state of the release unit 20*a* and/or the locking unit 36*a*, a force can be applied the eccentric element 104*a* by means of a tensioning element 106*a* of the release unit 20*a* and/or the locking unit 36*a*. The tensioning element 106*a* is preferably realized as a torsion spring. The tensioning element 106*a* applies to the eccentric element a spring force that acts in a direction away from the tensioning bolt 102*a*. As a result of a movement of the actuating element 22*a*, a movement transmission element 108*a*, in particular a toothed wheel, of the release unit 20*a* and/or of the locking unit 36*a* can be moved. The actuating element 22*a* preferably has an external toothing 110*a*, which is designed to engage in the movement transmission element 108*a*. The movement transmission element 108*a* is preferably designed to move the eccentric element 104*a* in dependence on a movement of the actuating element 22*a*, in particular at least in the direction of the tensioning bolt 102*a*. Preferably, the movement transmission element 108*a* is designed to move the eccentric element 104*a*, in particular at least in the direction of the tensioning bolt 102*a*, via a blocking element 112*a* of the release unit 20*a* and/or of the locking unit 36*a*. The blocking element 112*a* is preferably designed, in at least one state, to block a moment of the eccentric element 104*a* by the tensioning element 106*a*. The blocking element 112*a* preferably comprises a blocking offset, which is designed, at least in one state, to bear against a blocking face of the eccentric element 104*a*. The blocking element 112*a* preferably has at least one circular toothing segment, which is designed to act in combination with the movement transmission element 108*a*.

Arranging of the saw blade module 14*a* on the chainsaw 12*a* causes the tensioning bolt 102*a* to be inserted into the chainsaw 12*a*. As a result of a movement of the actuating element 22*a*, the blocking element 112*a* can be moved into a blocking position, via the movement transmission element 108*a*. The blocking element 112*a* comes to bear against the eccentric element 104*a* and moves it, contrary to the spring force of the tensioning element 106*a*, in the direction of the tensioning bolt 102*a*. Owing to the toothing of the blocking element 112*a*, the movement transmission element 108*a* and the actuating element 22*a*, a movement of the eccentric element 104*a* is ensured. The eccentric element 104*a* can move the tensioning bolt 102*a*, and/or hold it in a position, relative to the housing 60*a* for the purpose of tensioning and/or holding a tensioning of the cutting strand 18*a*. As a result of the actuating element 22*a* being moved into a release position, in which the saw blade module 14*a* can be removed from the chainsaw 12*a*, the blocking element 112*a* can be moved away from the eccentric element 104*a*. The eccentric element 104*a* can be moved into an initial position by the spring force of the tensioning element 106*a*. The tensioning bolt 102*a* can be moved independently of the eccentric element 104*a*. Pretensioning of the cutting strand 18*a* is effected by the pretensioning unit 82*a*.

Figure 4:
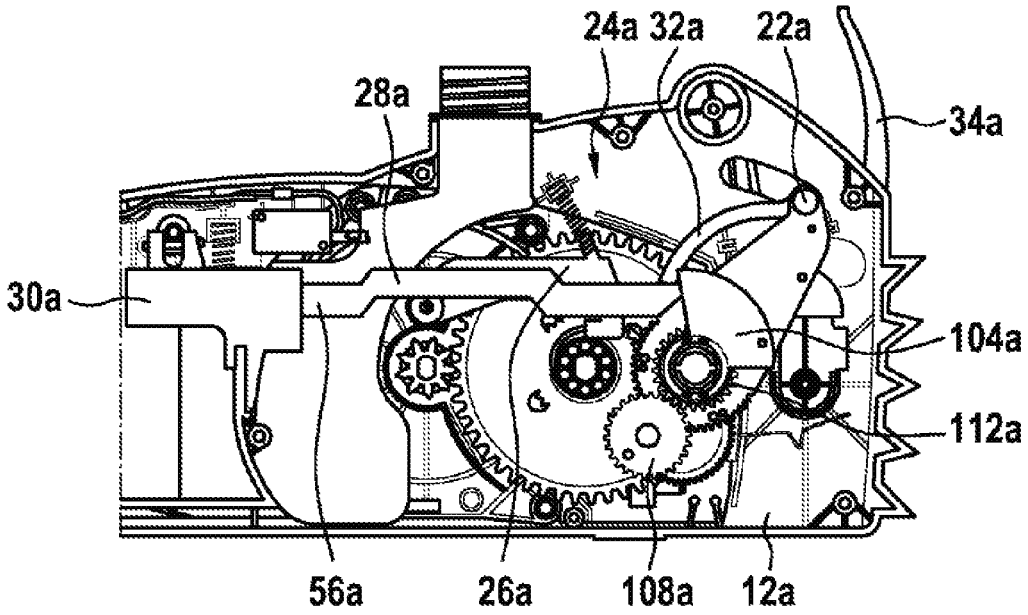
Figure 5:
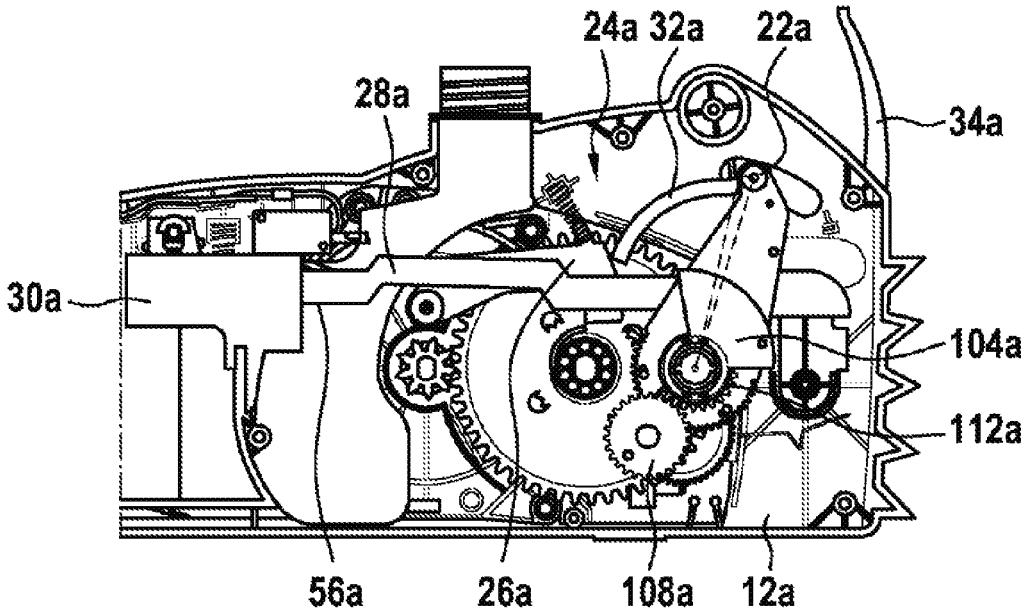
Figure 6:
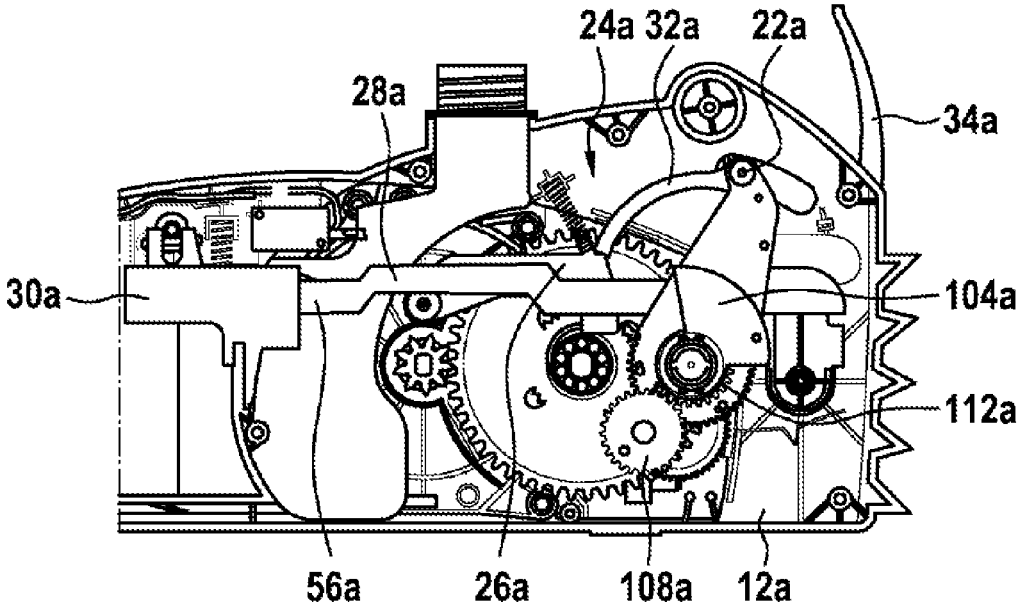

The chainsaw 12*a* has at least one blocking unit 24*a* that is designed to prevent the saw blade module 14*a*, coupled by means of the coupling unit 16*a*, from being decoupled by means of the release unit 20*a* while the chainsaw 12*a* is in operation. The blocking unit 24*a* is represented in FIGS. 4 to 6, in differing operating states. FIG. 4 shows the blocking unit 24*a* in an initial operating state. In particular, the blocking unit 24*a* is designed to prevent functioning of the release unit 20*a* during operation of the chainsaw 12*a*, in particular while a motor is running, in such a manner that undoing of the form-fit and/or force-fit connection, between the saw blade module 14*a* and the chainsaw 12*a*, that is produced by means of the coupling unit 16*a*, is prevented. The blocking unit 24*a* has at least one decoupling blocking element. 26*a* that is designed to block an actuation of the actuating element 22*a* of the release unit 20*a* while the chainsaw 12*a* is in operation (see FIG. 5). When the chainsaw 12*a* is in an idle state, the decoupling blocking element 26*a* is arranged entirely outside of an actuating course of the actuating element 22*a* of the release unit 20*a*. During operation of the chainsaw 12*a*, in particular while a motor of the chainsaw 12*a* is running, the decoupling blocking element 26*a* is arranged, at least partially, in a movement path of the actuating element 22*a* of the release unit 20*a*. The decoupling blocking element 26*a* is movably mounted and, upon the chainsaw 12*a* being put into operation, can be moved, in particular can be slid and/or swiveled, at least partially, into an actuating course of the actuating element 22*a* of the release unit 20*a*. The blocking unit 24*a* has at least one transmission element 28*a*, which operatively couples an operating switch 30*a* of the chainsaw 12*a* to the decoupling blocking element 26*a* and which is designed to transmit a movement of the operating switch 30*a* to the decoupling blocking element 26*a*. The transmission element 28*a* is realized as a transmission arm. One end 56*a* of the transmission element 28*a* is connected to the operating switch 30*a* of the chainsaw 12*a*. The end 56*a* of the transmission element 28*a* that is connected to the operating switch 30*a* is designed to follow a movement of the operating switch 30*a*, at least substantially. Preferably, the transmission element 28*a* is designed to follow a movement of the operating switch 30*a* at least substantially over its entire longitudinal extent. The decoupling blocking element 26*a* is arranged on the transmission element 28*a*, and connected to it. The transmission element 28*a* is designed to transmit a movement of the operating switch 30*a* to the decoupling blocking element 26*a* in such a manner that the decoupling blocking element 26*a* is in an actuating course of the actuating element 22*a* of the release unit 20*a*, at least partially, when the operating switch 30*a* of the chainsaw 12*a* is in an operating position. An actuation of the actuating element 22*a* of the release unit 20*a* is thereby blocked. The transmission element 28*a* is also designed to transmit a movement of the operating switch 30*a* to the decoupling blocking element 26*a* in such a manner that the decoupling blocking element 26*a* is entirely outside of actuating course of the actuating element 22*a* of the release unit 20*a*, when the operating switch. 30*a* of the chainsaw 12*a* is in an idle position. An actuation of the actuating element 22*a* of the release unit 20*a* is possible in this state.

The blocking unit 24*a* is also designed to prevent the chainsaw 12*a* from being put into operation while the release unit 20*a* is in a decoupling mode. The blocking unit 24*a* is designed, in particular, to prevent the chainsaw 12*a* from being put into operation as long as the actuating element 22*a* of the release unit 20*a* is in a decoupling position. In particular, the blocking unit 24*a* is designed to prevent a motor of the chainsaw 12*a* from being put into operation while the release unit 20*a* is in a decoupling mode. The blocking unit 24*a* has at least one operation blocking element 32*a* that is designed to block an actuation of the operating switch 30*a* of the of the chainsaw 12*a* while the release unit 20*a* is in a decoupling mode (see FIG. 6). The operation blocking element 32*a* is designed to mechanically block an actuation course of the operating switch 30*a* while the release unit 20*a* is in a decoupling mode. In particular, the operation blocking element 32*a* is designed to block the operating switch 30*a* of the chainsaw 12*a* in a release position while the release unit 20*a* is in a decoupling mode. The operation blocking element 32*a* is connected to the actuating element 22*a* of the release unit 20*a*, or is at least partially integral with the actuating element. 22*a* of the release unit 20*a*. The operation blocking element 32*a* is designed to follow a movement of the actuating element 22 of the release unit 20*a*. The operation blocking element 32*a* is designed to act upon the decoupling blocking element 26*a* and block a movement of the decoupling blocking element 26*a* when the actuating element 22*a* of the release unit 20*a* is in a decoupling position. The decoupling blocking element 26*a* is arranged on the transmission element 28*a*, and connected to it, with the result that a movement of the transmission element 28*a* is likewise blocked by the blocking of the decoupling blocking element 26*a*. The transmission element 28*a* is connected to the operating switch 30*a* of the chainsaw 12*a*, with the result that the movement of the operating switch 30*a* is also blocked.

Figure 7:
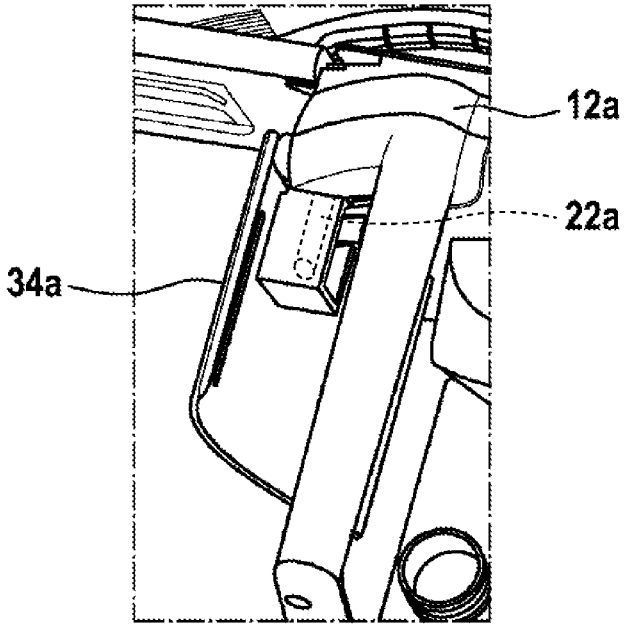
Figure 8:
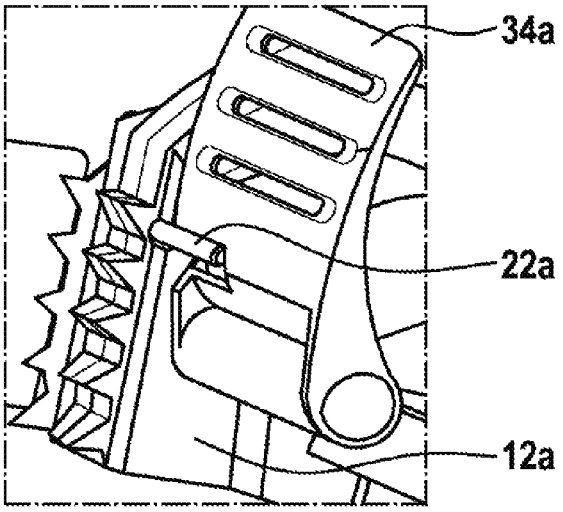
Figure 9:
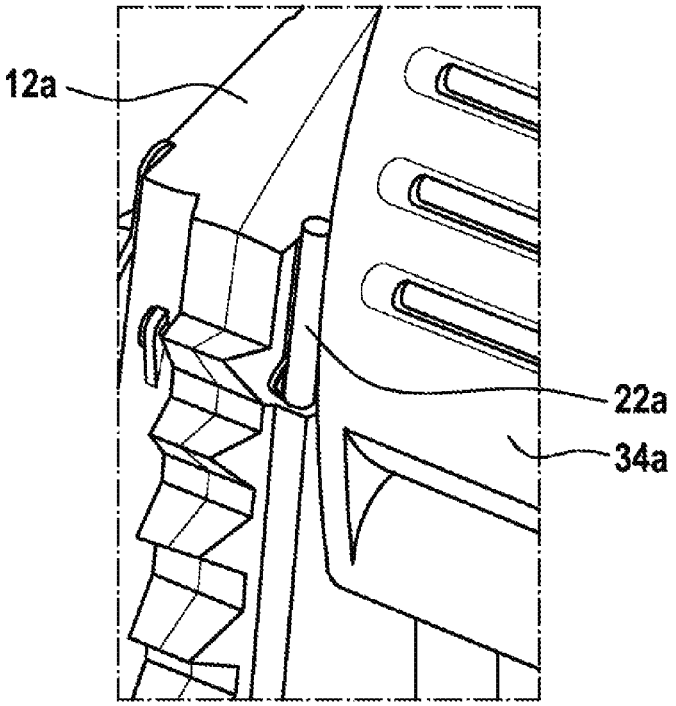

The chainsaw 12*a* also has at least one recoil safeguard element 34*a*. The recoil safeguard element 34*a* may be designed to prevent, at least to a large extent, a manual actuation of the actuating element 22*a* of the release unit 20*a* while the chainsaw 12*a* is in operation. The recoil safeguard element 34*a* is realized as a recoil lever. The recoil safeguard element 34*a* is designed, in the case of a recoil of the chainsaw system 10*a* resulting from an actuation by an operator of the chainsaw system 10*a*, to be brought from an operating position into a brake position. In particular, the recoil safeguard element 34*a* may be designed, in the brake position, to cause the chainsaw 12*a*, in particular the motor of the chainsaw 12*a*, to brake. The recoil safeguard element 34*a* is designed, in the operating position, to mechanically cover the actuating element 22*a* of the release unit 20*a*, at least partially, and preferably at least to a large extent. FIGS. 7 to 9 show differing embodiments of a recoil safeguard element 34*a* that covers the actuating element 22*a* of the release unit 20*a*, at least partially, and preferably at least to a large extent.

Figure 10:
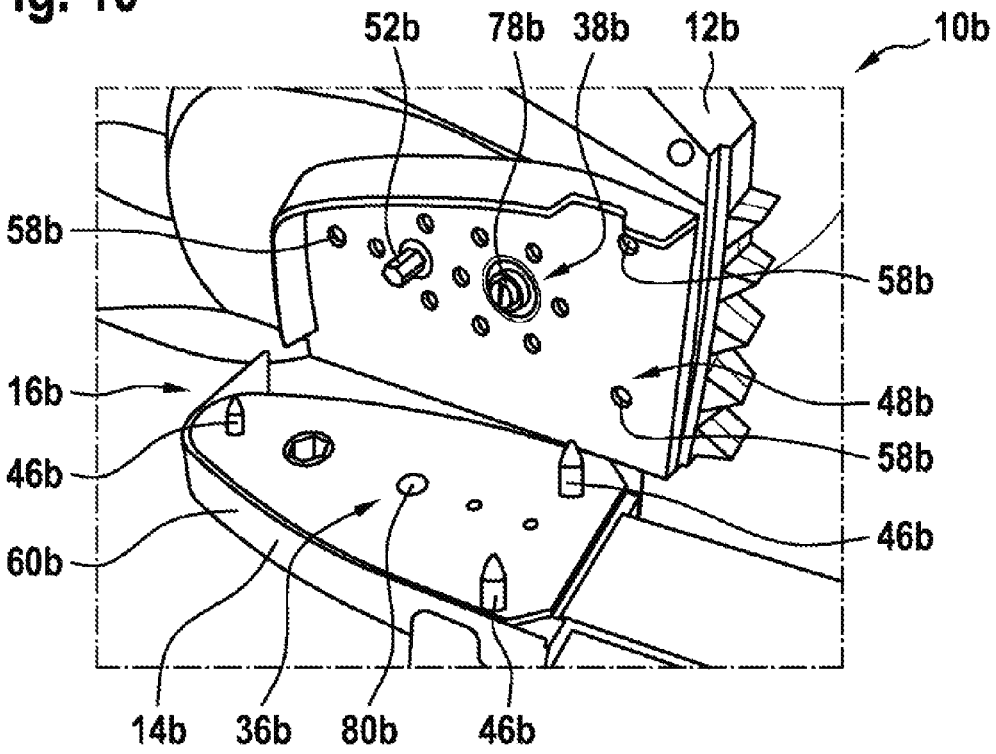

FIG. 10 shows a further exemplary embodiment of the disclosure. The following descriptions and the drawings are limited substantially to the differences between the exemplary embodiments and, in principle, reference may be made to the drawings and/or the description of the other exemplary embodiments, in particular to FIGS. 1 to 9, in respect of components having the same designation, in particular in respect of components having the same reference numerals. To distinguish the exemplary embodiments, the letter a has been appended to the references of the exemplary embodiment in FIGS. 1 to 9. In the exemplary embodiments of FIG. 10, the letter a has been replaced by the letter b.

FIG. 10 shows an alternative chainsaw system 10*b* in an unmounted state, in which the saw blade module 14*b* has been decoupled from the chainsaw 12*b*. The chainsaw system 10*b* has a coupling unit 16*b* for coupling the saw blade module 14*b* to the chainsaw 12*b*. The coupling unit 16*b* is designed to connect the saw blade module 14*b* to the portable chainsaw 12*b*, by means of a form-fit and/or force-fit connection, for the purpose of performing work on a workpiece. In particular, when the coupling unit 16*b* is connected to the chainsaw 12*b* and the chainsaw 12*b* is in an operating state, forces and/or torques are transmitted from a transmission unit of the chainsaw 12*b* to the saw blade module 14*b*, for the purpose of driving the cutting strand 18*b*. Preferably, the chainsaw 12*b* has torque transmission element 52*b* which, when the saw blade module 14*b* is coupled to the chainsaw 12*b* by means of the coupling unit 16*b*, engages in the cutting strand 18*b* for the purpose of driving the cutting strand 18*b*. The torque transmission element 52*b* is arranged in a rotatably mounted manner on the chainsaw 12*b*. The torque transmission element 52*b* may be realized, in particular, as a toothed shaft 54*b* of a transmission unit of the chainsaw 12*b*. The chainsaw 12*b* has at least one receiving recess 48*b* that is designed to receive the saw blade module 14*b*, at least partially, in a mounted state. The receiving recess 48*b* has at least one inner contour that corresponds, at least substantially, to an outer contour of a housing 60*b* of the saw blade module 14*b*.

The coupling unit 16*b* has a locking unit 36*b*, and at least one locking element 38*b* that is designed to latch within the locking unit 36*b*. The locking element 38*b* is arranged on the chainsaw 12*b*. The locking unit 36*b* is arranged on the saw blade module 14*b*. The locking element 38*b* has a latching and/or expansion head 78*b*. Upon the saw blade module 14*b* being coupled to the chainsaw 12*b*, the latching and/or expansion head 78*b* latches in a recess 80*b* of the locking unit 36*b*. The coupling unit 16*b* also has at least one positioning bolt 46*b* that is designed to align and/or orient the saw blade module 14*b* relative to the chainsaw 12*b*. For example, the coupling unit 16*b* has three positioning bolts 46*b*, while the chainsaw 12*b* has a corresponding number of receivers 58*b* for the positioning bolts 46*b*. Upon the saw blade module 14*b* being mounted on the chainsaw 12*b*, the positioning bolts 46*b* engage in the receivers 58*b* for the purpose of positioning saw blade module 14*b* relative to the chainsaw 12*b*.

The invention claimed is:

1. A chainsaw system, comprising:

a chainsaw;

a saw blade module comprising a cutting strand and at least one guide unit configured to guide at least a part of the cutting strand;

a coupling unit configured to releasably couple the saw blade module to the chainsaw; and a release unit mounted on the chainsaw and including an actuating element mounted on the chainsaw and rotatable about an axis extending transversely through the chainsaw and configured to decouple, without use of tools, the saw blade module from the chainsaw.

2. The chainsaw system as claimed in claim 1, further comprising:

at least one blocking unit mounted on the chainsaw and configured at least to prevent the saw blade module, coupled by the coupling unit to the chainsaw, from being decoupled by the release unit while the chainsaw is in operation.

3. The chainsaw system as claimed in claim 1, wherein the chainsaw has at least one recoil safeguard element configured to prevent, at least to a large extent, a manual actuation of the actuating element of the release unit while the chainsaw is in operation.

4. The chainsaw system as claimed in claim 1, wherein the coupling unit has at least one locking unit and at least one locking element configured to latch within the at least one locking unit.

5. The chainsaw system as claimed in claim 4, wherein the at least one locking element has at least one locking head, and the locking unit has at least one locking element is configured to engage behind the at least one locking head, at least in a locking state.

6. The chainsaw system as claimed in claim 4, wherein the at least one locking unit has at least one magnet element configured, in at least one operating state, to exert a holding force upon the at least one locking element.

7. The chainsaw system as claimed in claim 1, wherein the coupling unit has at least one positioning bolt configured to at least one of align and orient the saw blade module relative to the chainsaw.

8. The chainsaw system as claimed in claim 1, wherein the chainsaw has at least one receiving recess configured to at least partially receive the saw blade module in a mounted state.

9. A chainsaw system, comprising:

a chainsaw having at least one release unit and at least one blocking unit;

a saw blade module comprising a cutting strand and at least one guide unit configured to guide at least a part of the cutting strand; and at least one coupling unit configured to couple the saw blade module to the chainsaw, wherein the at least one release unit includes at least one actuating element, the at least one release unit configured to decouple, without use of tools, the saw blade module from the coupling unit, wherein the at least one blocking unit is configured at least to prevent the saw blade module, coupled to the chainsaw by the at least one coupling unit, from being decoupled by the at least one release unit while the chainsaw is in operation, and wherein the at least one blocking unit has at least one decoupling blocking element configured to block an actuation of the at least one actuating element while the chainsaw is in operation.

10. The chainsaw system as claimed in claim 9, wherein:

the at least one blocking unit has at least one transmission element configured to operatively couple an operating switch of the chainsaw to the at least one decoupling blocking element, and the at least one transmission element is configured to transmit a movement of the operating switch to the at least one decoupling blocking element.

11. A chainsaw system, comprising:

a chainsaw having at least one release unit and at least one blocking unit;

a saw blade module comprising a cutting strand and at least one guide unit configured to guide at least a part of the cutting strand; and at least one coupling unit configured to couple the saw blade module to the chainsaw, wherein the at least one release unit includes at least one actuating element, the at least one release unit configured to decouple, without use of tools, the saw blade module from the coupling unit, and wherein the at least one blocking unit is configured at least to prevent the chainsaw from being put into operation while the at least one release unit is in a decoupling mode.

12. The chainsaw system as claimed in claim 11, wherein the at least one blocking unit has at least one operation blocking element configured to block an actuation of an operating switch of the chainsaw while the at least one release unit is in the decoupling mode.

* * * * *